United States Patent [19]

Petracci

[11] 4,157,737

[45] Jun. 12, 1979

[54] MECHANIC DEVICE FOR THE AUTOMATIC CONTROL, AT TWO SPEEDS, OF WINCHES OF PILE-DRIVERS

[76] Inventor: Bernardo Petracci, Via Fontana del Monaci, 9, Ciampino, Rome, Italy

[21] Appl. No.: 851,204

[22] Filed: Nov. 14, 1977

[51] Int. Cl.[2] ..... B25D 9/00

[52] U.S. Cl. ..... 173/81

[58] Field of Search ..... 173/81, 82, 83, 84, 173/85, 86, 87, 88, 89

[56] References Cited

U.S. PATENT DOCUMENTS

| | | | |
|---|---|---|---|
| 2,082,865 | 6/1937 | Wigness et al. | 173/85 |
| 3,351,047 | 11/1967 | Barker | 173/81 |
| 3,842,916 | 10/1974 | Watanabe | 173/81 |
| 3,938,595 | 2/1976 | Swenson | 173/87 |

*Primary Examiner*—Robert A. Hafer

*Attorney, Agent, or Firm*—J. Harold Nissen

[57] ABSTRACT

A mechanic device that can be applied to pile-drivers, as to render automatic the control of the winch to lift the probe-weight of said machines, and allowing, at the same time, to perform the work at two different percussion speeds.

9 Claims, 4 Drawing Figures

MECHANIC DEVICE FOR THE AUTOMATIC CONTROL, AT TWO SPEEDS, OF WINCHES OF PILE-DRIVERS

The present invention concerns a mechanical device which can be applied to pile-drivers in order to provide for automatic control of the winch so as to lift the probe-weight of the machines, while at the same time, enabling the pile driver to perform the work at two different percussion speeds.

Up to now, the pile-drivers, provided with a winch, which are used to make or realize wells or soundings, had a mechanism to approach the drum of the winch. This winch carries the rope up to support and lift the probe - to the transmission crown of the movement transmitted by the motor, so as to render liable, by means of an annular clutch, the rotations of said crown and said drum, during the contact.

The approaching mechanism is controled by controlled manually operated lever, so that every time a pression is performed on the lever, the winch is put into rotation by the motor and lifts the probe-weight through a height determined by the time during which the lever is operated; as soon as the lever is disconnected, the winch is freed from the crown, and the weight of the probe falls down, letting the rope freely slide, and, therefore, fore, putting the drum, which is no longer engaged with the crown, into rotation, and to permit the performance of a digging percussion for the well that is being realized or dug.

It is evident that the engine has to be controlled by expert and skilful workmen, whose maximum possibilities do not overpass 50 percussions per minute, which represents the human, physical and mental limits of a person.

An aim of the present invention is to render the functioning of the pile-driver completely automatic, and furthermore to provide two different percussion speeds, the second of which is surely higher than any that can be reached by the best workman.

The aforesaid aim is reached, according to the present invention, by applying to the control lever of the winch an articulated, adjustable rod, provided with an incorporated locking spring. The rod is operated by the motor of the winch by means of two or more gears, which are in reciprocal gear ratio, and which can vary from 3/1 to 12/1, with an appropriate change of speed.

In this way it is possible to perform, at every rotation of the toothed crown, on which is clutched the drum of the winch, one or more percussions of the probe-weight.

One of the possible, exemplifying but not limitative embodiments according to the present invention is shown in the FIGS. 1 to 4 of the accompanying drawings.

Figures 1, 2:
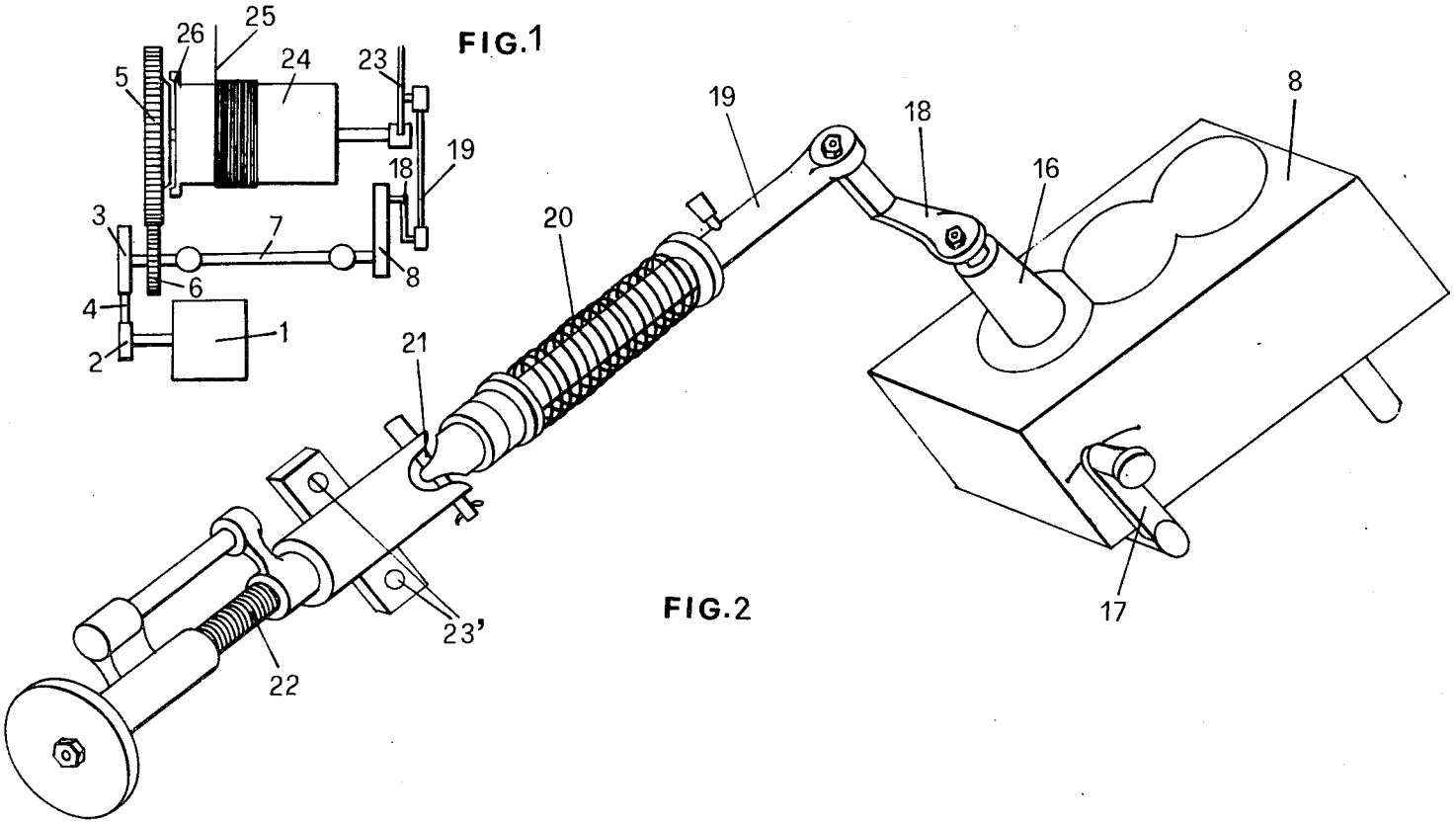
FIG. 1 is a schematic view of the device, according to the invention, with its pile-driver, i.e., with its winch.
FIG. 2 is an axonometric view of the control rod.

Referring to the drawings, 1 shows the electric or endothermic motor of the pile-driver, the movement of which is transmitted, by means of pulleys 2 and 3 engaged with belt 4, to crown 5 of the winch, through gear 6, and to the gears of the device according to the invention, through driven-shaft 7. However, the object of the invention can also be applied with an immediate connection of the extremities of the movement, without the application of the driven-shaft.

Figure 3:
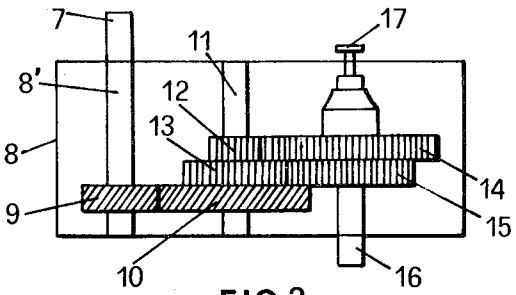
FIG. 3 is a section through the housing for the gears for the transmission of the movement to the rod.
Figure 4:
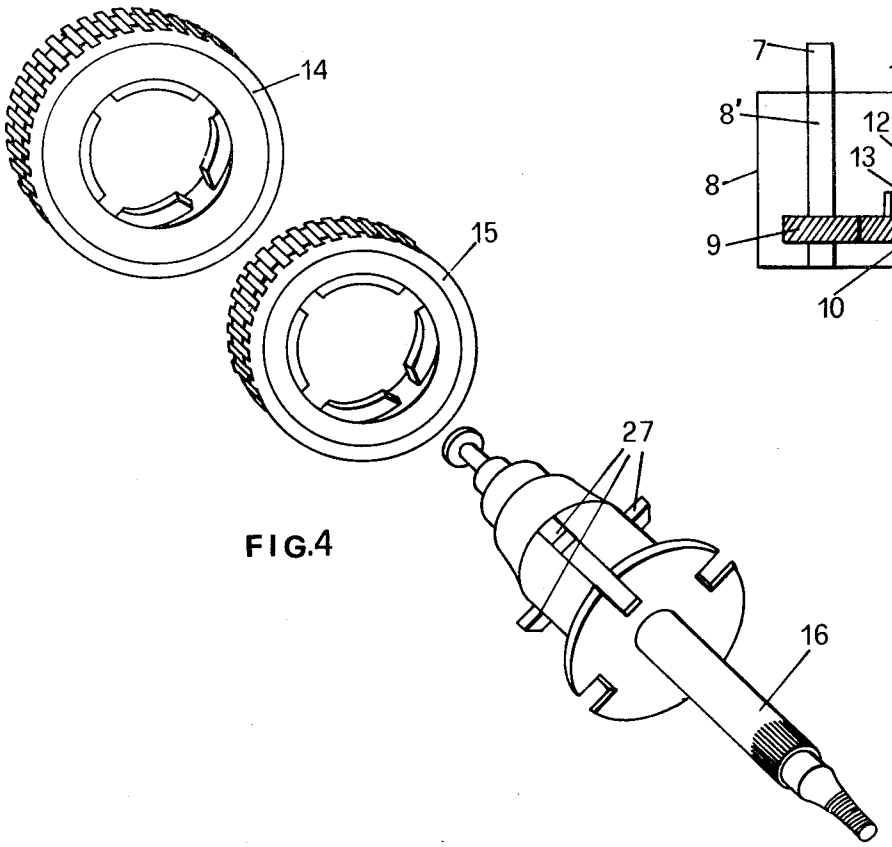
FIG. 4 is an axonometric view of details for the changing of speed.

In transformation housing 8, an internal shaft 8', see FIG. 3, is connected to driven-shaft 7. The internal shaft carries helicoidal gear 9, which in turn is in direct drive with gear 10 carried by driven-shaft 11, which is also provided with right gears 12 and 13. The gears 12 and 13 each is in direct drive with a pair of respective coaxial gears 14 and 15 of different diameters and different gear ratio. These coaxial gears 14 and 15 carried are carried by external shaft 16 and are therefore able to operate external shaft 16, at different speeds as they are provided with different gear ratios by means of a movable cross operating system 27. The gear ratios are externally controlled by means of knob 17 which is connected to one end of shaft 16. By means of knob 18 connected with rod 19 and shaft 16 rod 19 is placed into movement, and rod 19 is provided with locking spring 20, with Cardan joint 21 and with adjusting screw 22. The rod is screwed with tongues 23' to the control lever of pile driver 23, which is provided with the drum of winch 24, which carries rope 25, said rope lifting the probe-weight and said drum being put into movement through clutch-device 26, by means of crown 5.

The installation and the functioning of the object of the invention can be described as follows:

internal shaft 8' of transformation housing is fixed to driven-shaft 7 or to any other drive of the motor, and connecting rod 19, by means of screws inserted into tongues 23', to the control lever of the winch, so that from that moment on said lever will be operated automatically. In fact, the rotation of the shaft 8' is transmitted to gears 9, 10, 12 and 13 and consequently to shaft 11, according to the respective gear ratio, and therefore also to gears 14 and 15, which are always in contact. The last gears are alternatively liable, and therefore they transmit the motion according to their gear ratio to shaft 16 which comes out of the housing, by inserting cross 27 into the corresponding internal gear housings, which insertion is controlled by the external lever-knob 17. It is also provided the neutral position of the knob corresponding to the housing of cross 27 in a suitable slot, performed in the internal pitch circle of the gears: in said neutral position the shaft does not move and therefore the automatic control of the winch is blocked.

Otherwise, with one of the two speeds, rod 19, by means of knob 18, performs a compression or pression on locking spring 20 and operates on the control lever of drum 24, so that the probe-weight connected to rope 25, is lifted, and consequently lowered, in average and in an exemplifying embodiment, 30÷42 times per minute at the first speed, and 50÷80 times per minute at the second speed. Furthermore, it is evident that even if with a different gear ratio, the head of rod 19 moves in synchrony with the rotation of toothed crown 5. The optimal gear ratio of rotation between the gears has prooved to be of 6 to 1, but the device according to the invention can work with all ratios comprised between 3/1 and 12/1.

In the reversal of rod 19, the control lever will be slowly brought back, due to the locking spring 20, in this way winch 24 is detached or disconnected from crown therefore and threfore setting rope 25 free, and in this way, making the probe-weight fall down again.

The object of the invention has prooved to be easy in its realization and use, as well as resistant and cheap.

It is understood that the details of the realization of the object of the invention can be varied, with respect to what has been described and illustrated, without going out of the limits of protection of the present invention.

What I claim is:

1. A mechanical device for use with pile drivers having winches for the automatic control thereof, including a probe-weight, a winch drum having a crown for clutching thereof and carrying a rope fixed to said probe-weight to have said probe-weight perform work at two different percussion speeds, a control lever connected with said winch, a motor geared with said winch, a transformation gear arrangement geared with said motor and said winch, and an articulated, adjustable rod connected with said control lever and said transformation gear arrangement for operation therethrough of said rod by said motor, said transformation gear arrangement including at least two gears in a variable reciprocal gear ratio variable from 3/1 to 12/1 by means of a change of speed, said rod including a locking spring connected intermediate the ends thereof, one end being connected with said transformation gear arrangement for operative connection therethrough with said motor and said other end being coupled with said control lever for operation of said winch through said rod, to perform at every rotation of the crown one or more percussions of the probe-weight.

2. The mechanical device according to claim 1, wherein said transformation gear arrangement comprises:

a housing, a drive shaft within said housing having an end extending outside of said housing, a first helicoidal gear on said drive shaft within said housing, a driven shaft within said housing, a second helicoidal gear on said driven shaft coupled with said first helicoidal gear, a pair of right gears on said driven shaft, an external shaft in said housing having one end extending out of said housing and coupled with said rod and having its other end extending out of said housing, a pair of coaxial gears of different gear ratio and different diameters in direct drive with said pair of right gears, respectively and carried by said external shaft within said housing, and movable cross-change of speed means coupled with said external shaft and said pair of coaxial gears to vary the gear ratios to operate said external shaft at different speeds.

3. The mechanical device according to claim 2, wherein said change of speed means includes registry means for movement of said coaxial gears from a neutral position in which said external shaft is stationary to block the automatic control of said winch to the various gear ratio stages.

4. The mechanical device according to claim 3, wherein said external shaft is movable to at least two operative positions and a neutral position by said movable cross-change of speed means, and wherein one of said two operative positions corresponds to 30 to 42 percussions per minute, and the other of said operative positions corresponds to 50 to 80 percussions per minute.

5. The mechanical device according to claim 2, including a Cardan (universal) joint connecting an adjusting screw with said rod.

6. The mechanical device according to claim 5, including a clutch device associated with said crown for putting said winch into movement, and the movement of said rod is in synchronism with said crown.

7. The mechanical device according to claim 4, wherein rotation of said second external shaft by said motor is transmitted to said first external shaft and to said control lever.

8. The mechanical device according to claim 2, including a knob coupled to said other end of said external shaft for changing the gear ratio.

9. The mechanical device according to claim 2, wherein said drive shaft includes:

a second external shaft having one end geared to said motor and said crown and said other end operatively coupled with said first helicoidal gear, and a second driven shaft within said housing having one end connected with said other end of said external shaft and its other end connected with said first helicoidal gear.

* * * * *